US005194121A

United States Patent [19]

Taguchi et al.

[11] Patent Number: 5,194,121

[45] Date of Patent: Mar. 16, 1993

[54] NEEDLED FELT FOR PAPERMAKING USE

[75] Inventors: Hiroshi Taguchi, Osaka; Masayuki Ito, Narashino; Junichi Kaneko, Warabi, all of Japan

[73] Assignees: Nippon Felt Co. Ltd.; Dainippon Ink & Chemicals, Inc., both of Tokyo, Japan

[21] Appl. No.: 689,946

[22] PCT Filed: Nov. 29, 1989

[86] PCT No.: PCT/JP89/01202

§ 371 Date: May 24, 1991

§ 102(e) Date: May 24, 1991

[87] PCT Pub. No.: WO90/06398

PCT Pub. Date: Jun. 14, 1990

[30] Foreign Application Priority Data

Nov. 30, 1988 [JP] Japan ..... 63-154834
Nov. 29, 1989 [JP] Japan ..... 1-137345

[51] Int. Cl.[5] ..... D21F 3/00
[52] U.S. Cl. ..... 162/358.1; 162/900
[58] Field of Search ..... 162/DIG. 1, 358, 900, 162/358.1; 428/234, 300, 280, 282

[56] References Cited

U.S. PATENT DOCUMENTS 4,251,588 2/1981 Goetemann et al. ..... 162/DIG. 1
4,701,368 10/1987 Kiuchi et al. ..... 428/284
4,919,997 4/1990 Twilley ..... 428/300

*Primary Examiner*—W. Gary Jones
*Assistant Examiner*—Brenda Lamb
*Attorney, Agent, or Firm*—Kenyon & Kenyon

[57] ABSTRACT

A needled felt for papermaking use of the present invention comprises fibers (having a specific fineness or diameter) formed of a polyamide block copolymer, particularly, polyamide block copolymer having hard segments composed of polyamide components such as nylon 12 and soft segments composed of polyether components, the felt of the present invention is excellent in elasticity, recovery and durability compared with other fibers exhibiting rubber-like elasticity such as polyurethane elastic fibers, in addition, the felt of the present invention facilitate needling which has been difficult with prior art rubbery elastic fibers.

3 Claims, 1 Drawing Sheet

NEEDLED FELT FOR PAPERMAKING USE

TECHNICAL FIELD

The present invention relates to a needled felt for papermaking use, more particularly to a needle punched felt comprising fibers or filaments formed of a polyamide block copolymer.

BACKGROUND ART

In the manufacture of paper, paper sheets containing water are carried by a felt from a wire part to a press part, in which water is expressed, and then the resulting paper sheets are fed to a drying part to finish them as final paper sheets. Thus, the felt acts as means for receiving wet paper sheets dewatered in the wire part to convey it to the press part, further squeezing the water out by passing it between two press rolls and smoothing surfaces of the wet paper sheets at the same time, and sending them to the drying part. Accordingly, the felt must have at least three functions, namely the function of serving as a conveyer for conveying the wet paper sheets, the function of squeezing the most possible water out of the wet paper sheets, and the function of smoothing the surfaces of the wet paper sheets. For this reason, the felt is required to be seamless, to be a fibrous structure excellent in water squeezability, elasticity and recovery, and to have a surface which does not produce unevenness on the finished paper sheets.

Recently, the papermaking speeds of paper machines become higher, and therefore the felts must also run resisting the high speed operations. For this reason, the felts also call for durability, and properties required for the felts have become higher and more precise. The papermaking felts have been shifted from the former type of woven wool felts to needled synthetic fiber felts, and polyamide fibers are used for fibrous batt layers or base fabrics.

Fibers exhibiting rubber-like elasticity, such as polyurethane elastic fibers, have formerly known. However, the elastic fibers are generally difficult to use as felt materials. It is difficult to card the elastic fibers with carding machines, and sufficient compactness can not be obtained on the needling thereof. When the elastic fibers are needle punched, only local portions mechanically stressed are largely deformed, and the original fiber arrangement is regained on the removal of the applied stress. As a result, the sufficient three-dimensional entanglement of the fibers can not be produced. The enforcement of the entanglement causes breakage and damage to the fibers, and uneven tension induced on the felt formation disturbs the formation of uniform felts. It has been therefore considered difficult to manufacture an uniform felt composed of the elastic fibers which are uniformly arranged and having stable qualities and properties like the felts composed of the conventional usual fibers.

It is therefore an object of the present invention to provide a needled felt for papermaking use excellent in elasticity, recovery, durability etc, overcoming the difficulty in manufacture of felt, especially in needling process, and maintaining properties of felt.

Other objects and novel features of the invention will be apparent from the following description and claims, taken in connection with the accompanying drawings.

DISCLOSURE OF INVENTION

The present invention in order to achieve such object relates to a needled felt for papermaking use having a base fabric and fibrous batt layer overlaid on one surface or both surface of said base fabric, said base fabric and said fibrous batt layer being unified by needling, which characterized in that said fibrous batt layer and/or said base fabric mainly comprises fibers formed of a polyamide block copolymer, said fibers comprised in said fibrous batt layer being fibers of 4 to 50 denier, and said fibers comprised in said base fabric being woolen yarns composed of fibers of 4 to 50 denier, multifilament yarns each filament of which has a fineness of 4 to 50 denier or monofilament yarns having a diameter of 0.1 to 0.8 mm.

In desirable working mode, said polyamide block copolymer is a block copolymer having hard segments composed of polyamide components and soft segments composed of polyether components, said fibrous batt layer is composed of a plurality of layers, an outermost layer of which comprises the fiberes formed of the polyamide block copolymer and an inner layer of which comprises polyamide fibers.

In the present invention, we have examined to use elastic fibers in a needled felt for papermaking use having a base fabric and fibrous batt layer overlaid on one surface or both surface of said base fabric, the base fabric and the fibrous batt layer being unified by needling, but we are known above-mentioned troubles.

Then, in the present invention, the fibrous batt layer and/or the base fabric were composed of fibers or filaments formed of a block polyamide copolymer, especially fibers or filaments are formed of a block copolymer composed of hard segments consisting of polyamide and soft segments consisting of polyether components, and having a specific fineness and specific diameter. As a result, the felt of the present invention is excellent in compressive elastic recovery at a press part of a papermaking machine. Consequently, the thickness of the felt can be maintained even after it has been pressed hundreds of thousand of times. Further, the felt is high in energy absorption against deformation and is improved in durability. The pressure distribution of felt may be maintained uniform to prevent the felt from the generation of felt mark (marks caused by unevenness in water content or in thickness) and to prevent press rolls of the papermaking machine from the generation of vibration. The felt of the present invention is capable of overcoming the difficulty in trouble for production such as the trouble in the work of needling exhibited in the use of usual elastic fibers, in maintaining the properties of the felt.

Previously, with the long-term use of the felt, the fibers on the surface thereof were torn off by friction, and the broken separated fibers adhered on the surface of the wet paper sheet when the felt came into contact with the wet paper sheet between the press rolls. The separated fibers moved to a printing type side on printing to the paper sheet, and its mark was transferred to paper sheets to be printed by turns. This problem was a serious obstacle on printing. However, according to the present invention, the above-mentioned polyamide block copolymer fibers used in the felt absorbed force induced by momentary dragging friction between the felt and the rolls, due to their high energy adsorption. Hence, the fibers are only elongated, and does not come to breakage. Namely, the unexpected effect is obtained that no fibers are torn off and separated from the surface of the felt.

DESCRIPTION OF THE PREFERRED EMBODIMENTS

The present invention will hereinafter be described in more detail by way of example with reference to the drawings.

Figure 1:
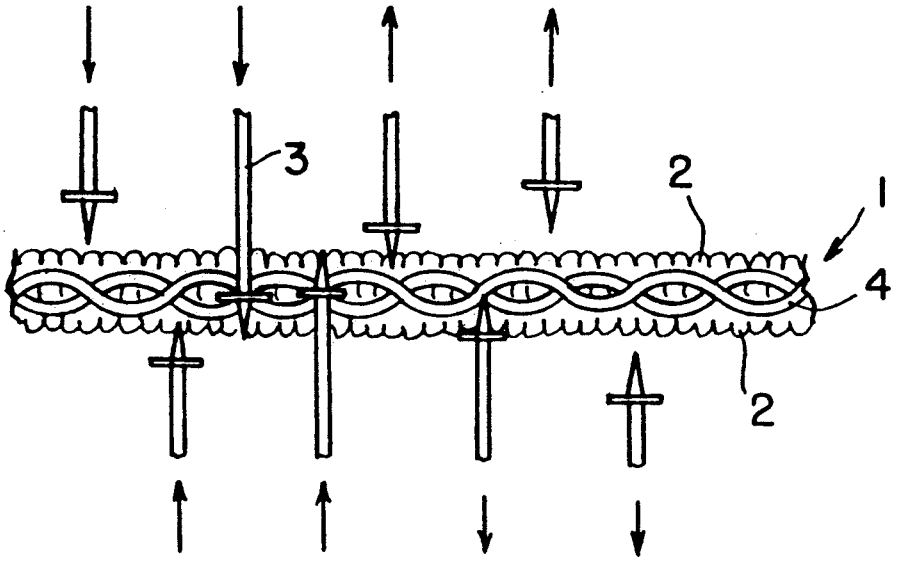
FIGS. 1 and 2 are schematic views showing respective felts for papermaking use embodying the present invention.
Figure 2:
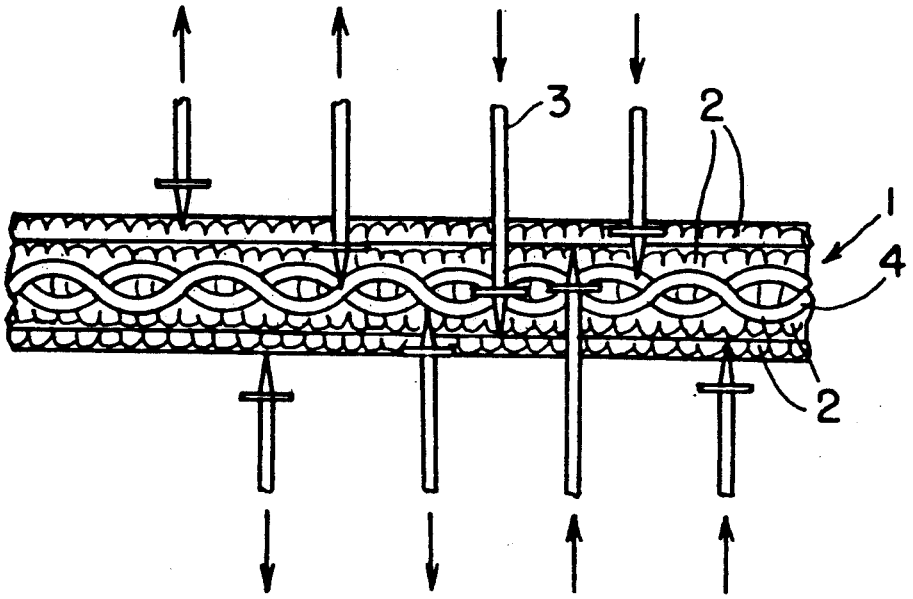

In a needled felt 1 for papermaking use reffered FIG. 1 and 2, that fibrous batt layers 2 comprises fibers formed of a polyamide block copolymer. Further, at these drawings, a sign No. 3 is needles, and No. 4 is a base fabric.

The polyamide block copolymers used in the present invention are block copolymers having hard segments consisting of polyamides such as nylon 6, nylon 66, nylon 11 and nylon 12 and soft segments consisting of polyether components.

Examples of the polyamides constituting the hard segments include polycondensation products of dicarboxylic acids such as terephthalic acid, isophthalic acid, oxalic acid, adipic acid, sebacic acid and 1,4-cyclohexyldicarboxylic acid and diamines such as ethylenediamine, pentamethylenediamine, hexamethylenediamine, decamethylenediamine, 1,4-cyclohexyldiamin and m-xylylenediamine; polymerization products of cyclic lactams such as caprolactam and laurolactam; polycondensation products of aminocarboxylic acids such as aminoenanthic acid, aminononanoic acid and aminoundecanoic acid; and copolymerization products of the above-mentioned cyclic lactams, dicarboxylic acids and diamines.

For the polyether components constituting the soft segments, as staring materials are used diamines represented by the following general formula:

$$H_2N\text{-}(CH_2)_a\text{-}O[(CH_2)_b\text{-}O]_c\text{-}[(CH_2)_d\text{-}O]_e\text{-}(CH_2)_f\text{-}NH_2$$

where a, b, d and f are integers of at least 2, preferably 2 to 4, e is an integer of 2 to 30 and c is an integer of 2 to 30.

Examples of such diamines include mixtures of bis (3-aminopropyl)-polytetrahydrofurans represented by the following general formula:

$$H_2N\text{-}(CH_2)_3\text{-}O[(CH_2)_4\text{-}O]_e\text{-}[(CH_2)_3\text{-}NH_2$$

where e is an integer of 2 to 30, preferably 6 to 30, and bis-(3-aminoprppyl)-polypropylene oxide represented by the following general formula:

$$H_2N\text{-}(CH_2)_3\text{-}O\text{-}[\text{-}(CH_2)_3\text{-}O]_e\text{-}[(CH_2)_3\text{-}NH_2$$

where e is an integer of 2 to 30.

There may be also used polyether glycols such as polyoxypropylene glycol and polyoxytetramethyl glycol.

Such polyamide block copolymers are usually produced by the condensation reaction of the above-mentioned compounds forming the polyamide components with the above-mentioned polyether-containing diamines and dicarboxylic acids, and it is desirable to contain the above-mentioned polyether blocks in a ratio of 8 to 60% by weight. If the content of the polyether blocks is less than 8% by weight, the felt is decreased in the amount of elastic deformation, and therefore it becomes difficult to achieve the objects of the present invention. On the other hand, if this content exceeds 60% by weight, the felt is decreased in rigidity, and increased too much in the amount of elastic deformation. In this case, it becomes difficult to impart crimps to the fibers(to crimp the fibers for ease of carding and the like), and the production of the felt is liable to become difficult.

The dicarboxylic acids used for the production of the polyamide block copolymers include the dicarboxylic acids exemplified as the raw materials for the above-mentioned polyamide resins forming the hard segments, dimerized fatty acids having 36 carbons, mixtures of polymerized fatty acids principally containing the dimerized fatty acids, and a compound represented by the following formula:

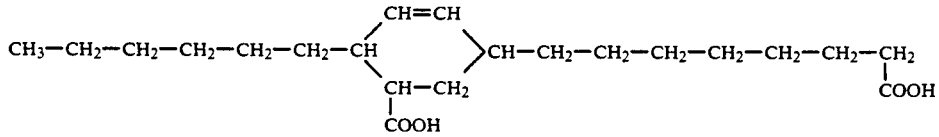

The polyamide block copolymers used in the present invention may be composed of block copolymers having soft segments consisting of polyester components instead of or in addition to polyether components.

The fibers of the present invention formed of the polyamide block copolymers described above do not exhibit elasticity as spandex yarns. However, the fibrous of the present invention have elasticity as compared with other fibers formed of polyamide, and have a breaking elongation of 80 to 100%.

When the fibers formed of the polyamide block copolymers described above are used, the fibers approximately completely recover by removing the stress after the initial elongation to 15 to 20% is applied. Hence, the felt comprising these fibers is improved in elasticity, and various effects described above and hereinafter described are obtained. On the other hand, in the manufacturing process of the felt, the fibers exhibit plasticity close to that of usual polyamide fibers in the needling procedure in which the fibers are forcedly elongated to a elongation of more than about 20%. Consequently, if the fibers are elongated by the behavior of depressing the fibers with needles in the downward direction of the felt during needling, the fibers do not easily recover. There does not occur, therefore, the disadvantage of the difficulty of achieving the compactness of the felt by needling.

In the base fabric portion of the felt, the fibers are arranged in a plane direction of the felt. As a result, elasticity against compression in a diameter direction of the fibers is required. Also in this case, the fibers formed of the polyamide block copolymers used in the present invention exhibit extremely high elasticity in a pressed region between the press rolls during papermaking.

These specific characteristics exhibited when the fibers are elongated and pressurized is considered to be based on that the restitution elasticity of the polyamide block copolymers is about 60% (JIS K6301) when the Shore D hardness thereof is 68°, and is significantly high compared to that of polyurethane elastomers of esters series or lacton series, 35 to 40% (JIS K6301) when the Shore D hardness of the polyurethane elastomers is 65±3°.

The fibers or filaments of the present invention may be used as the fibers or filaments formed of polyamide block copolymers with other polyamide resins.

Example of such polyamides include polycondensation products of dicarboxylic acids such as terephthalic acid, isophthalic acid, oxalic acid, adipic acid, sebacic acid and 1,4-cyclohexyldicarboxylic acid and diamines such as ethylenediamine, pentamethylenediamine, hexamethylenediamine, decamethylenediamine, 1,4-cyclohexyldiamine and m-xylylenediamine: polymerization products of cyclic lactams such as caprolactam and laurolacton; polycondensation products of aminocarboxylic acids as aminoenanthic acids, aminonanoic acids and aminoundecanoic acid; and copolymerization products of the above-mentioned cyclic lactams, dicarboxylic acids and diamines. Of these polyamides, examples of preferred polyamides include nylon 6, nylon 11, nylon 12, nylon 610, nylon 612, nylon 6/610 and nylon 6/66. Nylon 12 is represented by the following formula:

$$H-[NH-(CH_2)_{11}-CO]_n-OH$$

In the present invention, only the fibers formed of the above polyamide block copolymers may be used in the fibrous batt layer and/or the base fabric of the felt. However, fibers formed of other polyamide resins such as nylon 66, nylon 6, nylon 11, nylon 12 and nylon copolymers may be used in combination with the polyamide block copolymer fibers. Consequently, fibers and filaments formed of polyamide block copolymer of example 70% by weight as a main constituent may be mixed with fibers and filaments formed of above-polyamide of example 30% by weight.

It is suitable that the polyamide block copolymer fibers used in the fibrous batt layer have a fineness of 4 to 50 denier in order to achieve the objects of the present invention of improving the compactness of the felt (the three-dimensional entanglement of the fibers) by needling, increasing compressive elastic recovery, maintaining the thickness of the felt by its uniform pressure distribution and good recovery, improving the durability, and avoiding the occurrence of marks on printing, in consideration of energy required for fiber breakage. The fibrous batt layer of the felt according to the present invention may consist of the fibers formed of the polyamide block copolymer as a main constituent and the above-mentioned fibers formed of the polyamide resin other than the polyamide block copolymer.

Further, the fibrous batt layer may consist of the fibers formed of the polyamide block copolymer as a main constituent and other fibers used as the batt forming fibers in the art.

In the present invention, when the fibrous batt layer 2 has a double layer structure as shown in FIG. 2, the outermost layer (the surface layer) may be formed of the fiber web of the polyamide block copolymer or the mixed web of the polyamide block copolymer fibers and the other polyamide fibers, and the inner layer may be formed of the web of the usual fibers. Also, all the layers may be formed of the above-mentioned mixed web.

The base fabric 4 is formed in single layer form or in multi-layer form by using yarns such as synthetic monofilament yarns and multifilament yarns as warp yarns and/or weft yarns. Previously, elastic polyurethane fiber (spandex) yarns were sometimes used as the above-mentioned yarns. In the present invention, however, the base fabric 4 is formed of yarns composed of the fibers of the polyamide block copolymer. In the base fabric are comprised woolen yarns composed of polyamide block copolymer fibers of 4 to 50 denier, polyamide block copolymer multifilament yarns each filament of which has a fineness of 4 to 50 denier or polyamide block copolymer monofilament yarns having a diameter of 0.1 to 0.8 mm. There may be used mixed twisted yarns or mixed woven fabrics of the polyamide block copolymer fiber yarns, and the other polyamide fiber yarns and/or the usual fiber yarns other than the polyamide fibers.

The fineness or the diameter of the yarns used in the base fabric may be selected considering the width of a papermaking machine, papermaking speed, nip pressure, the kind of paper, contamination caused by pitch and the like. In the case of the monofilament yarns, if the diameter thereof is less than 0.1 mm, the felts become too soft because the yarns are formed of the materials essentially high in elasticity. As a result, the felt is reduced in dimensional stability and becomes easy to be soiled. On the other hand, if the diameter is more than 0.8 mm, the woven base fabric becomes coarse, which causes the base fabric to put marks on paper when the felt is used. Hence, the diameter of the monofilament is required to be within the range of 0.1 to 0.8 mm.

For the purpose of suppressing the vibration of the papermaking machine, it is desirable that the base fabric itself of the felt is mooth. In this point, polyamide block copolymer monofilament yarns provide smooth knuckles at the intersections of the yarns, due to their easy bending. Accordingly, the smooth surfaces of the felt are liabie to be odtained.

However, these polyamide block copolymer fibers easily elongate, so that it is desirable to use the polyamide block copolymer fibers as yarns in a width direction if the basic fabric in order to ensure dimensional stability. In respect to ensuring dimensional stability, in the case of multilayer base fabrics such as double layer fabrics and triple layer fabrics, the polyamide block copolymer fibers may be used in the most upper layer in which smoothness is required, and the usual fibers may be used in lower layers. The most upper layer of the multi-layer base fabric is free from concern for elongation. It is therefore also possible to use the polyamide block copolymer fibers in both advancing and width directions of the base fabric.

Thus, in an example of the present invention, a felt (an example of the present invention) was produced which had fibrous batt layers consisting of 70% by weight of fibers formed of a polyamide block copolymer and 30% by weight of usual batt fibers formed of nylon 66. This felt was compared to a felt (a comparative example) having fibrous batt layers consisting of 100% by weight of usual batt fibers formed of nylon 66, on a high-speed papermaking machine. As a result, the felt of the present invention was soft even after pressed about five hundred thousand times, but the felt of the comparative example was gradually reduced in softness with an increase in the number of presses before pressed about five hundred thousand times, and the pressure distribution also became non-uniform. Thus, the felt of the present invention is excellent in compressive elastic recovery at a press part of a papermaking machine. Consequently, the thickness of the felt can be maintained even after it has pressed long times. Further, the felt is high in energy absorption against deformation and improved in durability.

The felt of the present invention is similar to a woven felt of thus in that compressive elastic recovery is high.

The strength of the polyamide block copolymer fibers used in the present invention is twice that of wool (about 1.5 g/d), and the elongation thereof is also more than 3 times that of wool. The felt of the present invention is therefore high in energy absorption against deformation, and hence improved in durability. Namely, the properties thereof are similar to those of wool, and the lifetime thereof is very prolonged.

The polyamide block copolymer fibers according to the present invention have a breaking strength of 3 g/d and a breaking elongation of 80 to 100%. In contrast, the prior-art polyamide fibers have a breaking strength of 3 to 4 g/d and a breaking elongation of 40 to 50%. Thus, the energy required for fiber breakage of the polyamide block copolymer fibers is very high compared to that of the above-mentioned prior-art fibers. The felt of the present invention facilitate carding and needling which has been difficult with prior art rubbery elastic fibers.

We claim:

1. A needled felt for papermaking use having a base fabric and fibrous batt layer overlaid on one surface or both surfaces of said base fabric, said base fabric and said fibrous batt layer being unified by needling, wherein said fibrous batt layer and/or said base fabric mainly comprises fibers formed of a polyamide block copolymer having polyamide segments composed of at least one member selected from the group consisting of polycondensation products of dicarboxylic acids, polycondensation products of dicarboxylic acid and diamines, polymerization products of cyclic lactams, polycondensation products of aminocarboxylic acids, and copolymerization products of cyclic lactams, dicarboxylic acids, and diamines, and said polyamide block copolymer having polyether components composed of at least one member selected from the group consisting of diamines represented by the formula $H_2N\text{-}(CH_2)_a\text{-}O\text{-}[(CH_2)_b\text{-}O]_c\text{-}[(CH_2)_d\text{-}O]_e\text{-}(H_2)_f\text{-}NH_2$ where a, b, d, and f are integers of at least 2, e is an integer of from 2 to 30, and c is 0 or an integer of from 2 to 30, and polyether glycols, said fibers comprised in said fibrous batt layer being fibers of 4 to 50 denier, and said fibers comprised in said base fabric being woolen yarns composed of fibers of 4 to 50 denier, multifilament yarns each filament of which has a fineness of 4 to 50 denier or monofilament yarns having a diameter of 0.1 to 0.8 mm.

2. A needled felt for papermaking use as claimed in claim 1, in which said fibrous batt layer and/or said base fabric further comprises fibers formed of the polyamide block copolymer and fibers formed of another polyamide resin.

3. A needled felt for papermaking use as claimed in claim 1, in which said fibrous batt layer is composed of a plurality of layers, an outermost layer of which comprises the fibers formed of the polyamide block copolymer and an inner layer of which comprises fibers formed of another polyamide resin.

* * * * *